US005550420A

United States Patent [19]

Hsu

[11] Patent Number: 5,550,420

[45] Date of Patent: Aug. 27, 1996

[54] ELECTRONIC IGNITION APPARATUS

[75] Inventor: Kun-Chung Hsu, Shin Chuang, Taiwan

[73] Assignee: Chien Sheng Machine Industrial Co., Ltd., Taipei, Taiwan

[21] Appl. No.: 461,853

[22] Filed: Jun. 5, 1995

[51] Int. Cl.[6] ..... H01L 41/08

[52] U.S. Cl. ..... 310/339; 361/260

[58] Field of Search ..... 310/338, 339; 361/260; 431/255

[56] References Cited

U.S. PATENT DOCUMENTS

| | | | |
|---|---|---|---|
| 3,384,786 | 5/1968 | Oyamada et al. | 361/260 |
| 3,540,823 | 11/1970 | Ebine et al. | 431/255 |
| 3,576,383 | 4/1971 | Fuller et al. | 431/255 |
| 3,576,471 | 4/1971 | Schumacher | 361/260 |
| 3,986,061 | 10/1976 | Suzuki et al. | 310/339 |
| 4,153,852 | 5/1979 | Vainer | 310/339 |

*Primary Examiner*—Mark O. Budd

*Attorney, Agent, or Firm*—Jacobson, Price, Holman & Stern, PLLC

[57] ABSTRACT

An electronic ignition apparatus including a housing, a gas well mounted in a gas well chamber inside the housing, a piezoelectric igniter mounted in a trough inside the housing and triggered to produce sparks at the front end of the housing, a metal nozzle the mounted in a front chamber on the housing and connected to the gas outlet valve of the gas well by a connecting tube and a flexible gas tube between the connecting tube and the metal nozzle tube, a push bar mounted inside the housing and moved to trigger the piezoelectric igniter, a link connected between the connecting tube and the push bar and moved by the push bar to lift the connecting tube from the gas outlet valve for permitting fuel gas to be drawn out of the gas well into the metal nozzle tube for burning by the sparks.

11 Claims, 4 Drawing Sheets

ELECTRONIC IGNITION APPARATUS

BACKGROUND OF THE INVENTION

The present invention relates to an electronic ignition apparatus which comprises a housing, a gas well mounted in a gas well chamber inside the housing, a piezoelectric igniter mounted in a trough inside the housing and triggered to produce sparks at the front end of the housing, a metal nozzle tube mounted in a front chamber on the housing and connected to the gas outlet valve of the gas well by a connecting tube and a flexible gas tube between the connecting tube and the metal nozzle tube, a push bar mounted inside the housing and moved to trigger the piezoelectric igniter, a link connected between the connecting tube and the push bar and moved by the push bar to lift the connecting tube from the gas outlet valve for permiting fuel gas to be drawn out of the gas well into the metal nozzle tube for burning by the sparks.

A variety of ignition guns have been developed for use to burn fuel in a grate etc. These ignition guns commonly comprises a gas well to hold fuel gas, and a striker wheel for striking a flint to make sparks. Because these ignition guns use a striker wheel and a flint for making sparks, they are inconvenient to operate.

SUMMARY OF THE INVENTION

The present invention has been accomplished to provide an electronic ignition apparatus which uses a piezoelectric igniter and a gas well for making a flame. A commercially available disposable cigarette lighter can be used to replace the gas well so that fuel gas can be recharged through the bottom filling hole on the cigarette lighter.

BRIEF DESCRIPTION OF THE DRAWINGS

The present invention will now be described by way of examples with reference to the annexed drawings, in which.

DETAILED DESCRIPTION OF THE PREFERRED EMBODIMENT

Figure 1:
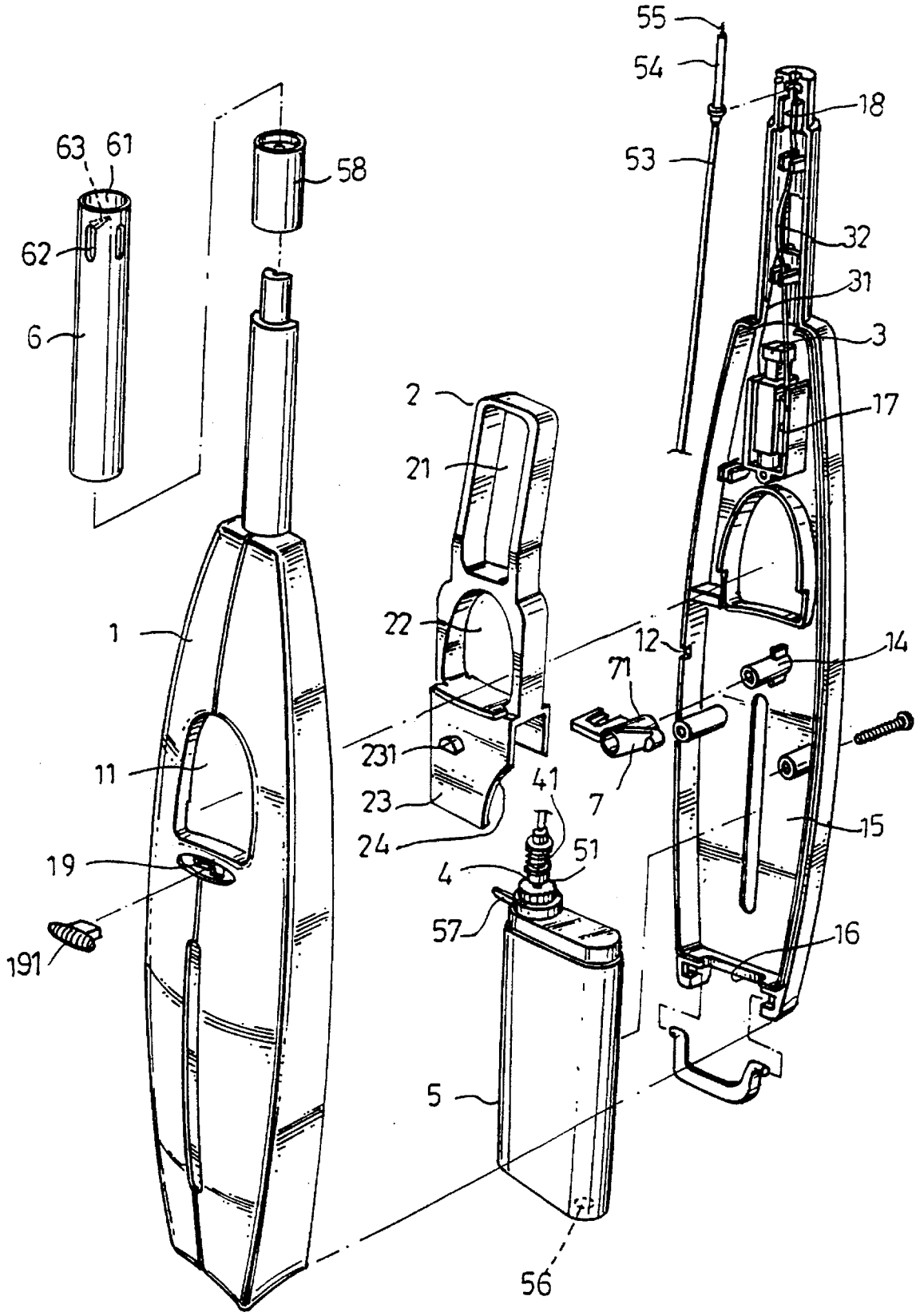
FIG. 1 is an exploded view of an electronic ignition apparatus according to the present invention.

Referring to FIG. 1, an electronic ignition apparatus in accordance with the present invention is generally comprised of a housing 1, a push bar 2, a piezoelectric igniter 3, a connecting tube 4, a gas well 5, a metal cap 6, and a link 7.

Figure 2:
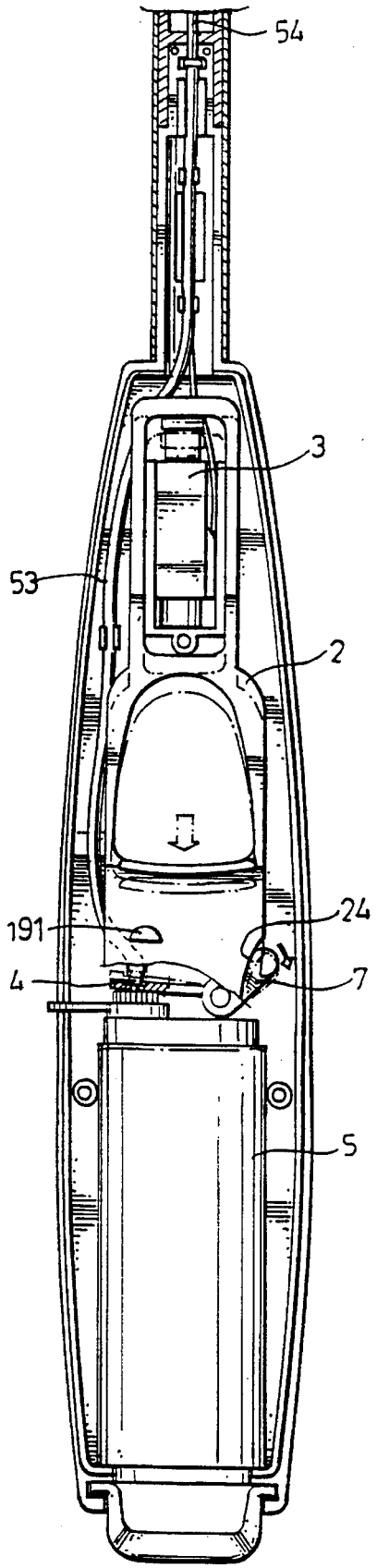
FIG. 2 is a plain view of the electronic ignition apparatus shown in FIG. 1, showing the push bar depressed, the link moved, and the piezoelectric igniter triggered.

Referring to FIG. 2 and FIG. 1 again, the housing 1 comprises an opening 11, an upright post 14 on the inside adjacent to the opening 11 for mounting the link 7, a gas well chamber 15, which receives the gas well 5, a bottom hole 16 in communication with the gas well chamber 15, a trough 17 adjacent to the opening 11 opposite to the upright post 14 for holding the piezoelectric igniter 3, a projecting front chamber 18, which receives a metal nozzle tube 54, a slot 19 disposed between the opening 11 and the upright post 14, and a finger plate 191 inserted into the slot 19 and coupled to a projecting rod 231 on the push bar 2. The metal cap 6 is mounted on the projecting front chamber 18, having a front hole 61 at the front end thereof through which the flame is driven out, a plurality of air holes 62 spaced around the front end, and a tip 63 suspended from the metal nozzle tube 54 for discharging of sparks. An insulative covering 58 is mounted on the housing 1 and retained between the projecting front chamber 18 and the metal cap 6. The link 7 is turned about the upright post 14 inside the housing 1, having one end coupled to the connecting tube 4 and an opposite end terminating in a projecting rod 71 coupled to the push bar 2. The gas well 5 comprises a gas outlet valve 51 connected to one end of the connecting tube 4. A spring 41 is mounted around the connecting tube 4 to hold the connecting tube 4 firmly in connection with the gas outlet valve 51. The opposite end of the connecting tube 4 is connected to the metal nozzle tube 54 by a flexible gas tube 53. The opposite end of the metal nozzle tube 54 is mounted with a spring nozzle 55 for output of fuel gas. The bottom side of the gas well 5 has a gas intake valve 56 through which fuel gas can be filled into the gas well 5. The gas well 5 further comprises a flame adjustment knob 57 extended out of a hole 12 on one side of the housing 1 for regulating fuel gas flowrate. The push bar 2 comprises an open frame 21 at one end disposed around the piezoelectric igniter 3 and the trough 17, a finger hole 22 in the middle aligned with the opening 11 on the housing 1 for the insertion of one finger to push the push bar 2, a flange 23 at an opposite end, a projecting rod 231 raised from the flange 23 and coupled to the finger plate 191, and a curved actuating edge 24 formed on the flange 23 and abutted against the link 7. The piezoelectric igniter 3 is a precision ceramic type piezoelectric igniter having two conductors 31 and 32 at two opposite terminals thereof respectively connected to the metal cap 6 and the metal nozzle tube 54.

Referring to FIG. 2 again, the finger plate 191 can be moved within the slot 19 between the operative position and the non-operative position. When the finger plate 191 is moved to the operative position, the curved actuating edge 24 is disposed in contact with the projecting rod 71 of the link 7, and the user can then insert one flinger into the opening 11 and the finger hole 22 to depress the push bar 2. When the push bar 2 is depressed, the curved actuating edge 24 forces the link 7 to move the connecting tube 4, causing a flow of fuel gas released from the gas well 5 into the connecting tube 4, the flexible gas tube 53 and the metal nozzle tube 54. At the same time, the piezoelectric igniter 3 is triggered by the front open frame 21 of the push bar 2 to discharge high voltage through the tip 63 and the metal nozzle tube 54, and therefore sparks are produced between the tip 63 and the metal nozzle tube 54 to burn the output flow of fuel gas in front of the spring nozzle 55.

Figure 3:
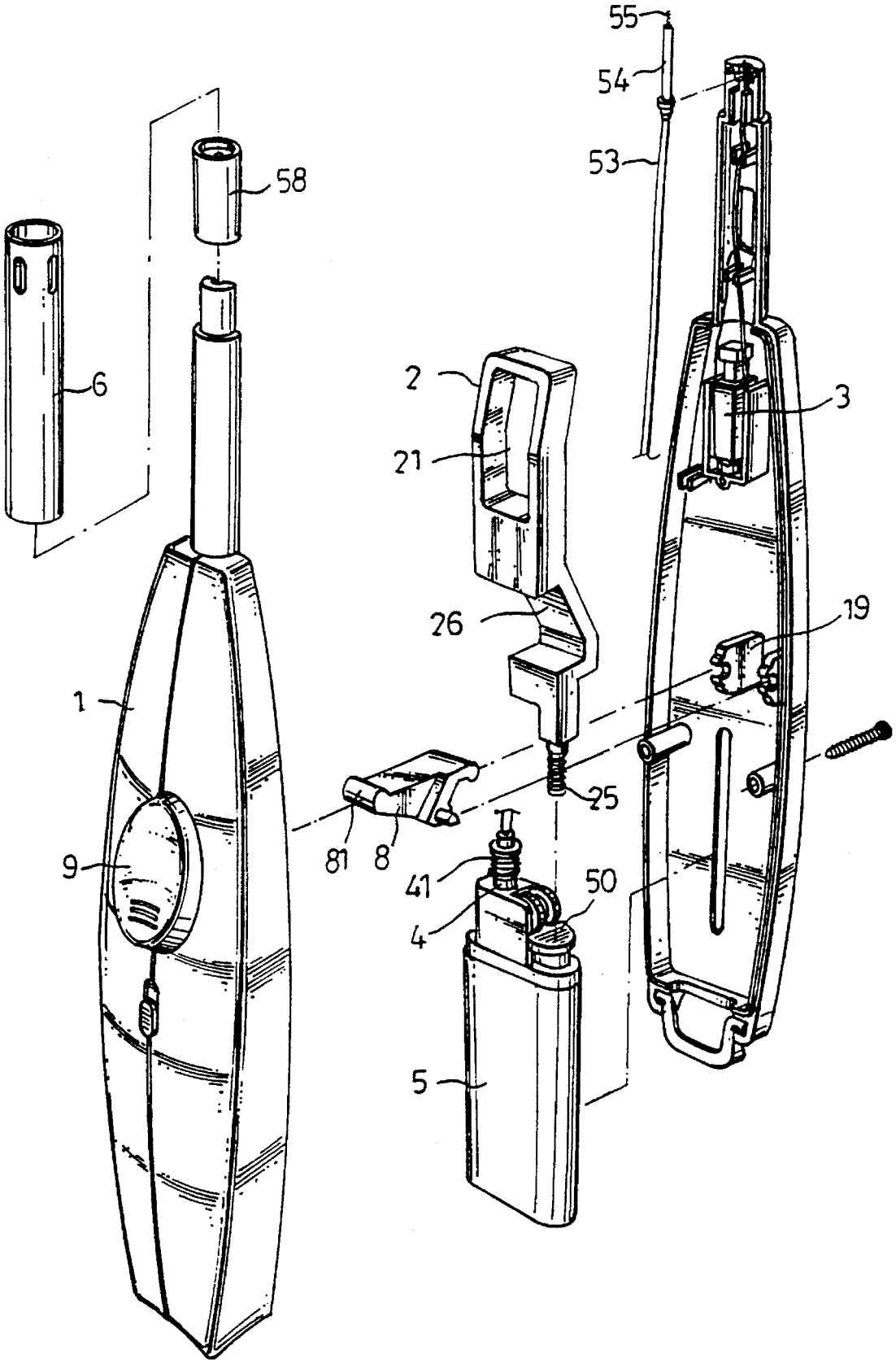
FIG. 3 is an exploded view of an alternate form of the electronic ignition apparatus according to the present invention.
Figure 4:
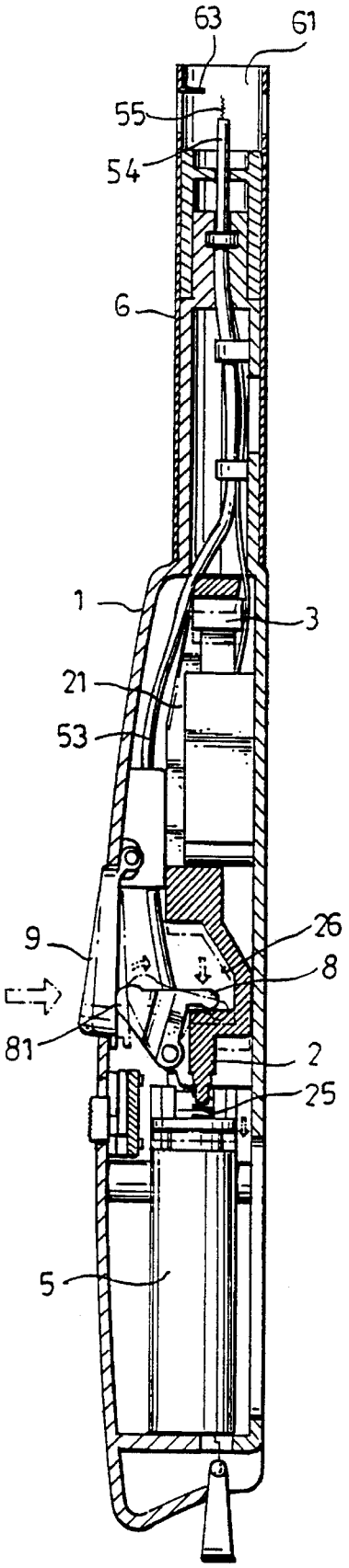
FIG. 4 is a plain view of the electronic ignition apparatus shown in FIG. 3, showing the push bar depressed, the link moved, and the piezoelectric igniter triggered.

FIG. 3 shows an alternate form of the present invention in which the gas well 5 is a commercially available disposable cigarette lighter having its gas lever 50 stopped below a spring 25 at the bottom side of the push bar 2; the push bar has a sloping recess 26 stopped against a link 8, which is pivotably connected between two upright supports 19 inside the housing 1 and has a coupling portion 81 abutted to a press button 9 on the housing 1. The operation of this alternate form is outlined hereinafter with reference to FIG. 4. When the press button 9 is depressed, the link 8 is forced to move the push bar 2, causing the gas lever 50 depressed by the spring 25 to open the connecting tube 4 for permitting a flow of fuel gas to be drawn out of the gas well 5 into the connecting tube 4 and the flexible gas tube 53 and then driven out of the spring nozzle 55 of the metal nozzle tube 54, and at the same time the piezoelectric igniter 3 is triggered to discharge sparks between the tip 63 and the metal nozzle tube 54 to burn the ejected flow of fuel gas.

It is to be understood that the drawings are designed for purposes of illustration only, and are not intended as a definition of the limits and scope of the invention disclosed.

I claim:

1. An electronic ignition apparatus comprising:

a housing, said housing comprising an opening, an upright support on the inside adjacent to said opening, a link pivoted to said upright support, a gas well chamber for holding a gas well, a trough adjacent to said opening opposite to said upright post for holding a piezoelectric igniter, a projecting front chamber, a push bar, a metal nozzle tube mounted in said projecting front chamber, a metal cap mounted on said projecting front chamber, a connecting tube having one end connected to said metal nozzle tube through a flexible gas tube and an opposite end for coupling to a gas well, said link having one end connected to said connecting tube and a second end terminating in a projecting rod for coupling to said push bar;

a piezoelectric igniter mounted in said trough and having two opposite terminals respectively connected to said metal cap and said metal nozzle tube by a respective conductor, said piezoelectric igniter being triggered when said push bar is depressed, causing sparks produced between said metal cap and said metal nozzle tube for burning fuel gas being ejected out of said metal nozzle tube; and a gas well mounted in said gas well chamber, said gas well having a gas outlet valve connected to said metal nozzle tube by said connecting tube and said flexible gas tube, said gas outlet valve being opened to release fuel gas into said connecting tube and said flexible gas tube and said metal nozzle tube for burning when said push bar is depressed to move said link.

2. The electronic ignition apparatus of claim 1 wherein said push bar comprises an open frame at one end disposed around said piezoelectric igniter and moved to trigger said piezoelectric igniter, a finger hole in the middle aligned with the opening on said housing for the insertion of one finger to depress said push bar, and a flange at an opposite end, said flange having a curved actuating edge abutted against a projecting rod on said link for permitting said link to be forced by said push bar to move said connecting tube in releasing fuel gas from said gas well when said push bar is depressed.

3. The electronic ignition apparatus of claim 1 wherein said gas well is a gas lighter having a gas lever for controlling said gas outlet valve.

4. The electronic ignition apparatus of claim 3 wherein said push bar comprises a spring at a bottom side thereof stopped at the gas lever on said gas lighter, and a sloping recess stopped against said link.

5. The electronic ignition apparatus of claim 1 further comprising an insulative covering mounted on said housing and retained between said projecting front chamber and said metal cap.

6. The electronic ignition apparatus of claim 1 wherein said metal nozzle tube has one end connected to said connecting tube through said flexible gas tube and an opposite end mounted with a spring nozzle.

7. The electronic ignition apparatus of claim 1 wherein said metal cap has a front hole through which the flame is drawn out of the electronic ignition apparatus.

8. The electronic ignition apparatus of claim 7 wherein said metal cap has a plurality of air vents around the periphery adjacent to the front hole of said metal cap.

9. The electronic ignition apparatus of claim 1 wherein said housing further comprises a slot, and a finger plate mounted in said slot and coupled to said push bar for moving said push bar between a first position in which said push bar is disconnected from said link, and a second position in which said push bar is connected to said link.

10. The electronic ignition apparatus of claim 4 wherein said housing comprises button hole, and a press button mounted in said button hole and coupled to said link and depressed to move said push bar and said link.

11. The electronic ignition apparatus of claim 1 wherein said connecting tube is mounted with a spring, which holds said connecting tube firmly in connection with said gas outlet valve of said gas well.

* * * * *